United States Patent [19]

Carey

[11] Patent Number: 4,911,583

[45] Date of Patent: Mar. 27, 1990

[54] STRUCTURE AND METHOD FOR SHORING A FACE OF AN EXCAVATION

[75] Inventor: Charles Carey, Poolesville, Md.

[73] Assignee: Schnabel Foundation Company, Bethesda, Md.

[21] Appl. No.: 212,137

[22] Filed: Jun. 28, 1988

Related U.S. Application Data

[63] Continuation of Ser. No. 622,876, Jun. 21, 1984, abandoned.

[51] Int. Cl.[4] ..... E02D 17/04; E02D 29/02

[52] U.S. Cl. ..... 405/262; 405/287

[58] Field of Search ..... 405/258, 262, 272, 284, 405/285, 286, 287

[56] References Cited

U.S. PATENT DOCUMENTS 4,505,621 3/1985 Hilfiker et al. ..... 405/284

*Primary Examiner*—David H. Corbin

*Attorney, Agent, or Firm*—Banner, Birch, McKie & Beckett

[57] ABSTRACT

A method and structure for shoring a generally vertical face of an excavation, wherein the face and adjacent ground are defined by soft shale or rock, or stiff soil, is disclosed. A plurality of relatively small diameter, relatively closely spaced and generally vertical holes are drilled into the ground adjacent a plane defining the face. Vertical rods are grouted in the holes to form generally vertical columns. Horizontal bars, and preferably, also tiebacks are inserted into the face and ground in a substantially horizontal direction as the excavation proceeds. The bars and tiebacks are connected to the columns.

19 Claims, 1 Drawing Sheet

STRUCTURE AND METHOD FOR SHORING A FACE OF AN EXCAVATION

This application is a continuation of application Ser. No. 622,876, filed June 21, 1984, now abandoned.

TECHNICAL FIELD

The present invention is directed to a construction technique for shoring a face of an excavation. The construction technique is designed to be used in specific ground conditions, i.e. where the ground is comprised of soft shale or rock, or still soil. Shoring the face of an excavation under these ground conditions is both difficult and expensive by current commercial techniques.

BACKGROUND OF THE INVENTION

The most common ground condition which occurs at excavation sites is loose soil. In this condition, the typical shoring technique includes driving soldier piles into the soil to a level below the subgrade and, as the excavation proceeds, attaching wood lagging to the soldier piles to support the soil at the generally vertical face of the excavation. This vertical face also extends laterally along the side of the excavation. Tiebacks are also frequency connected to this type of a structure to provide extra support. Examples of such structures are illustrated in U.S. Pat. No. 3,490,242 issued on Jan. 20, 1972 to H. Schnabel, Jr. and U.S. Pat. No. 4,369,004 issued on Jan. 18, 1983 to Weatherby.

Another shoring technique, is disclosed in U.S. Pat. No. Re 28,997 reissued on Sept. 28, 1976 to Mason. In this technique, the earth mass of the embankment acts as a monolithic structure because an array of dowels functions to support the weight of the soil and to prevent the formation of slip planes. A skin of pneumatically blown concrete and reinforcing mesh is placed over the face as the excavation proceeds.

A shoring technique which is used in the unique ground condition wherein a rock underlayer is located below an earthen or soil overburden, is disclosed in U.S. Pat. No. 3,541,798 issued on Nov. 24, 1984 to H. Schnabel, Jr. The technique disclosed in the '798 patent includes a sheeting wall which bears against the overburden with vertically extending soldier beams having their bases abutting the underlayer; tiebacks extending downwardly and outwardly from the wall through the overburden and into the underlayer; and support members having a cross-sectional area substantially less than the smallest circle which would enclose the cross section of the soldier beams extending downwardly from the base of the soldier beams into the underlayer. This technique provides support for both the earthen overburden and the rock underlayer.

Another ground condition which is difficult to shore is soft shale or rock, or still soil. This type of ground is too hard to simply drive piles into, yet is too soft to be self supporting during excavation. The vertical face of an excavation therefore must be supported by some structure. Typically, this type of face is supported by a technique wherein relatively large holes are drilled, e.g. two to three feet in diameter; and soldier beams are inserted into the drilled holes and set in concrete. Thereafter, as the excavation proceeds, wood lagging is attached to the concrete columns. While this technique adequately supports soft shale, soft rock and still soil, the technique is expensive to use because of the large drilling equipment which is required and the relatively long time needed to drill the large diameter holes.

The present invention was developed to reliably support loose rock or shale, or stiff soil at the face of an excavation in a more economical and less time consuming manner than current commercial techniques.

SUMMARY OF THE INVENTION

The present invention relates to a method for shoring a generally vertical face of an excavation wherein the face and adjacent ground are defined by soft rock or shale, or stiff earth. A plurality of relatively small diameter, relatively closely spaced and generally vertical holes are drilled into the ground adjacent a plane defining the face. Vertical rods are grouted in the holes to form generally vertical cement columns. Horizontal bars are inserted into the face and ground in a substantially horizontal direction as the excavation proceeds.

In a preferred embodiment, substantially horizontal holes are drilled into the face and ground, cement is injected in a liquid state into the substantially horizontal holes, and the horizontal bars are inserted. Also, tiebacks are installed into the face and ground as the excavation proceeds. The substantially vertical holes are spaced from one another by a distance of less than 4 feet, preferably about 2 feet apart; and the diameter of the holes is preferably about four inches.

The present invention is also directed to a structure for shoring the generally vertical face of the excavation.

The method and structure of the present invention exhibits numerous advantages over current commercial techniques for shoring excavations where the ground is comprised of soft shale or rock, or stiff soil. For example, since the holes which are drilled are relatively small, e.g. four inches, rather than the large holes required for the installation of soldier piles, e.g. two to three feet, conventional rock drilling equipment which is used for installing small diameter holes can be used, and the time required for excavation of the site can be reduced. The present invention also reduces the need for conventional line drilling since a barrier for the blast wave impacting the rock on the outside of the site is provided by the installed cement columns and horizontal bars. Conventional line drilling is a technique wherein numerous holes are drilled around the perimeter of a hole to be dug in rock in order to cause the hole to take the appropriate shape when the rock is dug or blasted. Furthermore, the present technique exhibits better results in defining the face than conventional line drilling wherein rock frequency breaks along undesired lines.

Various advantages and features of novelty which characterize the invention are pointed out with particularity in the claims annexed hereto and forming a part hereof. However, for a better understanding of the invention, its advantages, and objects attained by its use, reference should be had to the drawings which form a further part hereof, and to the accompanying descriptive matter, in which there is illustrated and described a preferred embodiment of the invention.

DETAILED DESCRIPTION OF THE INVENTION

Figure 1:
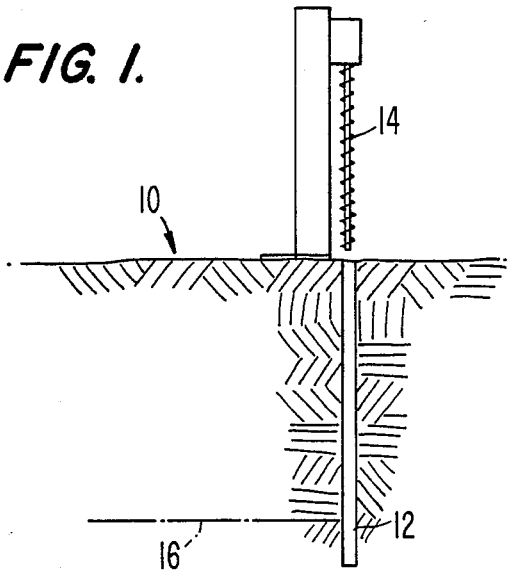
FIGS. 1-5 are an sectional views illustrating the steps of the method of shoring a generally vertical face at an excavation in accordance with the present invention.

Referring to the drawings, wherein like numerals indicate like elements, there is shown in FIG. 1 the ground located at an excavation site and a hole 12 drilled into the ground by a conventional rock drill 14. Hole 12 is drilled to depth below an intended subgrade 16. The ground surrounding the excavation site, in particular, in the area along the face of the excavation to be dug, is formed of soft shale, soft rock, stiff soil or the like. These terms are used to generically describe ground which is too hard to allow soldier piles to be driven into the ground, yet is too soft or fragile to be self supporting during the excavation process. This type of ground requires a support structure to support the face of the excavation.

Holes 12 are formed of a relatively small diameter, for example, less than 5 inches and are located relatively close to one another, for example, with the spacing between adjacent hole centers being less than 4 feet. Holes with a diameter of four inches and a spacing of two feet, center to center, have been found particularly useful. Holes 12 are located adjacent to a plane defining the generally vertical face.

Figure 2:
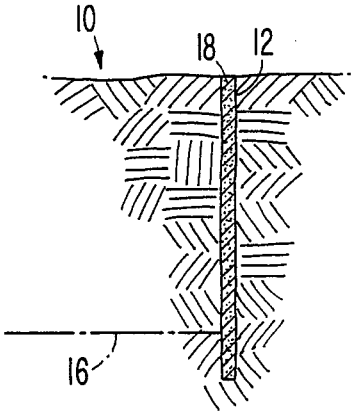
Figure 3:
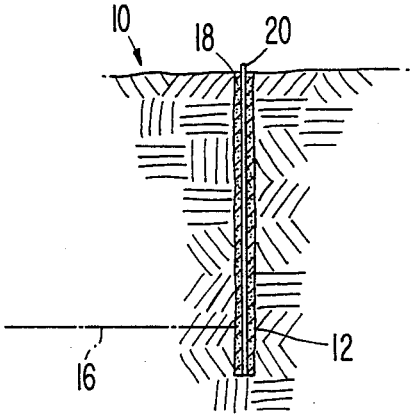

As seen in FIG. 2, cement 18 in a liquid state is poured into holes 12; and as seen FIG. 3, rods 20 are inserted into cement 18 while it is still in a liquid state. The order of pouring the cement and inserting the rods can be reversed, thereby the steps illustrated in FIGS. 3 and 4 being grouting the rods in the holes. Conventional cement, such as Portland can be used for cement 18; and conventional rods, e.g., 145 or 185 reinforcing bars formed of steel, can be used for rods 20. Rods 20 also have a relatively small diameter, for example, less than 5 inches, with rods having a diameter of two inches being particularly suitable. Cement 18 sets around rods 20 to form a plurality of generally vertically oriented columns 22. After the cement has set the excavation can proceed. Columns 22 are arranged along the plane of the face of the excavation.

Figure 4:
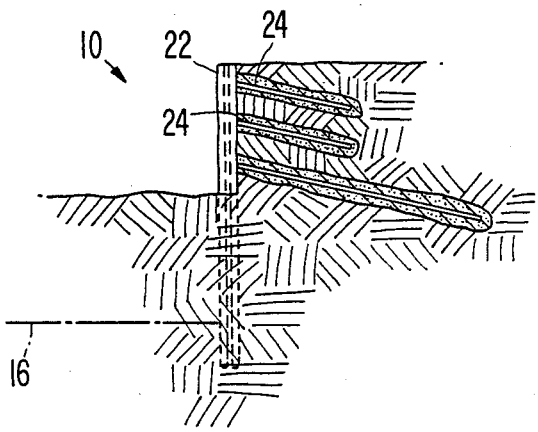
Figure 5:
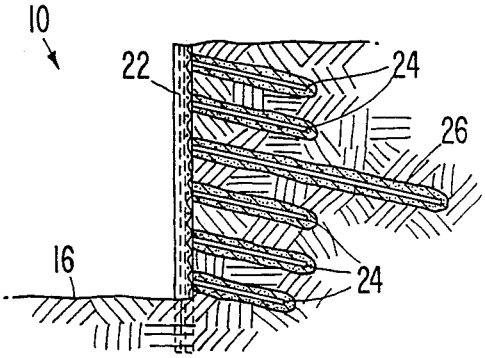
Figure 6:
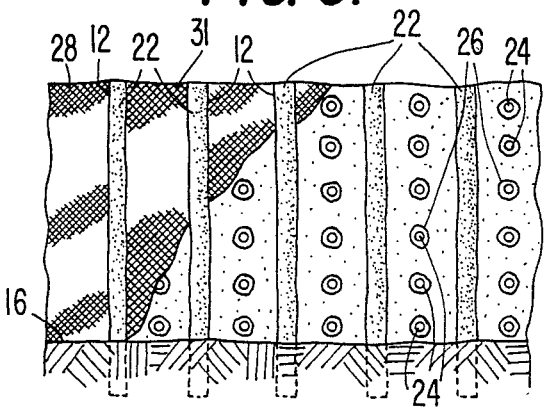
FIG. 6 is a front view of the face, shown extending laterally along the excavation, having a support structure in accordance with the present invention.

FIG. 4 illustrates a condition wherein the excavation has proceeded to approximately one half of its intended depth. As the excavation proceeds, generally horizontally oriented bars 24 are inserted through the face into the adjacent ground. As seen in FIG. 4, these generally horizontal bars are inserted at a slightly downward incline. Bars 24 are preferably inserted by first drilling generally horizontally orientated holes, injecting cement in a liquid state into the holes and inserting bars 24. In addition to the horizontal bars, tiebacks 26 are also inserted through the face of the excavation into the adjacent ground. Tiebacks 26 are inserted into holes drilled in the face and adjacent ground to a depth greater than the holes into which horizontal bars 24 are inserted. Tiebacks 26 are formed as conventional tiebacks wherein tendons or rods are surrounded with grout, tensioned and tested for set. As best seen in FIG. 6, horizontal bars 24 and tiebacks 26 are located adjacent column 22, and are connected to columns 22 in a conventional manner. As seen in FIG. 5, the insertion of horizontal bars 24 continues as the excavation proceeds down to the subgrade level 16. If additional support for the soft rock or shale, or stiff soil is required more tiebacks 26 can also be inserted. Also, if additional support for loose rock or soil along the face is required, an overlayer of a conventional chainlink fence 28, shown diagrammatically to the left of leftmost column 22 in FIG. 6, or sprayed concrete 31, shown diagrammatically to the right of the leftmost column 22 in FIG. 6, can be placed over the face.

Numerous characteristics and advantages of the invention have been set forth in the foregoing description, together with details of the structure and function of the invention, and the novel features thereof are pointed out in the appended claims. The disclosure, however, is illustrative only and changes may be made in detail, especially in matters of shape, size and arrangement of parts, within the principal of the invention, to the full extent indicated by the broad general meaning of the terms in which the appended claims are expressed.

I claim:

1. A method for shoring a face of an excavation, wherein the face and adjacent ground are defined by soft shale or rock, or stiff soil, comprising the steps of:

(a) drilling from the top surface of the ground a plurality of relatively small diameter, relatively closely spaced and generally vertical holes into the ground adjacent a plane defining the face;

(b) grouting rods to form generally vertical columns in said holes and define a barrier along the face of the excavation;

(c) excavating the ground away from the face of the excavation and along the barrier defined by the vertical columns;

(d) inserting bars transverse to the face and into the ground in a substantially horizontally direction and at locations between the vertical columns as the excavation proceeds.

2. A method in accordance with claim 1 wherein step (a) includes drilling said holes to a depth below subgrade.

3. A method in accordance with claim 1 wherein step (c) includes drilling substantially horizontal holes into the face and ground, injecting cement in a liquid state into the substantially horizontal holes, and inserting the horizontal bars.

4. A method in accordance with claim 1 including the step of applying a covering to the face for holding loose rocks or soil on the face.

5. A method in accordance with claim 1 wherein step (d) includes connecting said horizontal bars to said columns.

6. A method for shoring a face of an excavation, wherein the face and adjacent ground are defined by soft shale or rock, or stiff soil, comprising the steps of:

(a) drilling, prior to the excavation, a plurality of generally vertical holes to a depth below subgrade into the ground adjacent a plane defining the face, said holes having a diameter less than approximately 5 inches and a center to center spacing of less than approximately 4 feet;

(b) grouting vertical rods in said holes to form generally vertical columns and define a barrier along the face of the excavation;

(c) drilling a plurality of first and second substantially horizontal holes into the face and ground between the columns as the excavation proceeds, said second holes being drilled to a greater depth than said first holes;

(d) installing bars into said first holes, and (e) installing tiebacks into said second holes.

7. A method in accordance with claim 6 including the step of applying a covering to the face for holding loose rocks or soil on the face.

8. A method in accordance with claim 7 wherein said covering is a chain-link fence.

9. A method in accordance with claim 7 wherein said covering is shot concrete.

10. A method in accordance with claim 6 wherein said substantially vertical holes have a diameter of approximately four inches.

11. A method in accordance with claim 6 wherein said substantially vertical holes have a center to center spacing between adjacent vertical holes of approximately two feet.

12. A structure for shoring a face of an excavation, wherein the face and adjacent ground are defined by soft shale or rock, or stiff soil, comprising a plurality of substantially vertical cement columns with rod cores located along the face and extending downward from the top surface of the ground adjacent the excavation, said cement columns having a cross-sectional diameter less than 5 inches and center to center spacing less than 4 feet, and a plurality of substantially horizontal bars extending back from the face into the ground in the area between said columns.

13. A structure in accordance with claim 12 wherein said bars are surrounded by cement.

14. A structure in accordance with claim 12 including a covering over the face to hold loose rocks or soil on the face.

15. A structure in accordance with claim 12 wherein said horizontal bars are connected to said columns.

16. A method for shoring a face of an excavation, wherein the face and adjacent ground are defined by soft shale or rock, or stiff soil, comprising the steps of:

(a) drilling from the top surface of the ground a plurality of relatively small diameter, relatively closely spaced and generally vertical holes into the ground adjacent a plane defining the face;

(b) grouting rods to form generally vertical columns in said holes and define a barrier along the face of the excavation;

(c) excavating the ground away from the face of the excavation and along the barrier defined by the vertical columns;

(d) inserting bars traverse to the face and into the ground in a substantially horizontal direction as the excavation proceeds; and (e) installing at least one tieback transverse to the face and into the ground 17. A structure for shoring a face of an excavation, wherein the face and adjacent ground are defined by soft shale or rock, or still soil, comprising a plurality of substantially vertical cement columns with rod cores located along the face and extending downward from the top surface of the ground adjacent the excavation, said cement columns having a cross-sectional diameter less than 5 inches and center to center spacing less than 4 feet, a plurality of substantially horizontal bars and at least one tieback extending back from the face into the ground in the area between said columns.

18. A structure for shoring a face of an excavation, comprising:

a ground defined generall by soft shale, soft rock, stiff soil or the like and having a top surface and a vertical face which extends downward from the top surface;

a plurality of substantially vertical cement columns with rod cores disposed along the vertical face of the ground, said cement columns have a cross-sectional diameter less than 5 inches and a center to center spacing along the ground vertical face of less than 4 feet; and a plurality of bars extending into the ground in an approximately horizontal direction from the vertical face of the ground in an area between said columns.

19. A structure for shoring a face of an excavation, comprising:

a ground defined generally by soft shale, soft rock, stiff soil or the like and having a top surface and a vertical face which extends downward from the top surface;

a plurality of substantially vertical cement columns with rod cores disposed along the vertical face of the ground, said cement columns have a cross-sectional diameter less than 5 inches and a center to center spacing along the ground vertical face of less than 4 feet; and a plurality of bars and at least one tieback extending into the ground in an approximately horizontal direction from the vertical face of the ground in the area between said columns.

* * * * *